United States Patent [19]

French

[11] 4,147,388

[45] Apr. 3, 1979

[54] METHOD FOR IN SITU RECOVERY OF LIQUID AND GASEOUS PRODUCTS FROM OIL SHALE DEPOSITS

[75] Inventor: Gordon B. French, Bakersfield, Calif.

[73] Assignee: Occidental Oil Shale, Inc., Grand Junction, Colo.

[21] Appl. No.: 867,090

[22] Filed: Jan. 5, 1978

Related U.S. Application Data

[63] Continuation of Ser. No. 716,583, Aug. 23, 1976, abandoned, which is a continuation-in-part of Ser. No. 505,363, Sep. 12, 1974, abandoned.

[51] Int. Cl.[2] ..... E21B 43/24; E21C 41/10

[52] U.S. Cl. ..... 299/2; 166/251; 166/259

[58] Field of Search ..... 166/57, 247, 251, 256, 166/259, 302; 299/2

[56] References Cited

U.S. PATENT DOCUMENTS

| | | | |
|---|---|---|---|
| 50,903 | 11/1865 | Casamajor | 299/2 |
| 1,919,636 | 7/1933 | Karrick | 299/2 |
| 2,481,051 | 9/1949 | Uren | 299/2 |
| 2,801,089 | 7/1957 | Scott, Jr. | 299/2 |
| 3,072,188 | 1/1963 | Morse | 166/256 X |
| 3,490,529 | 1/1970 | Parker | 166/256 |
| 3,586,377 | 6/1971 | Ellington | 299/2 X |
| 3,589,773 | 6/1971 | Dixon | 166/247 X |
| 3,601,193 | 8/1971 | Grady | 166/259 X |
| 3,661,423 | 5/1972 | Garret | 299/2 |
| 3,765,722 | 10/1973 | Crumb | 299/2 |
| 3,952,801 | 4/1976 | Burton | 166/256 |

FOREIGN PATENT DOCUMENTS

| | | | |
|---|---|---|---|
| 614415 | 12/1948 | United Kingdom | 299/2 |
| 392243 | 10/1973 | U.S.S.R. | 299/2 |

*Primary Examiner*—Stephen J. Novosad
*Assistant Examiner*—George A. Suchfield
*Attorney, Agent, or Firm*—Christie, Parker & Hale

[57] ABSTRACT

A tunnel is formed above an in situ oil shale retort in a subterranean deposit containing oil shale. A void is excavated in the retort site and remaining deposit in the retort site is fragmented by explosively expanding toward the void to form a subterranean cavity containing a fragmented permeable mass of particles containing oil shale. The top of the fragmented mass is spaced downwardly from the tunnel to leave therebetween a pillar of unfragmented deposit. A retorting gas is introduced into the retort through a plurality of sloping passages from the tunnel for retorting oil shale in the fragmented mass. The liquid and gaseous products of such retorting are removed from the bottom of the retort. A portion of the carbonaceous products are used for generating electricity. In working a large area of deposit, a plurality of retorts are arranged in rows and columns. The tunnel is part of a tunnel system communicating with the tops of the retorts and having a peripheral double entry tunnel surrounding the rows and columns of retorts. Tunnel systems are also provided at a level adjacent the bottom of the retorts and at a level between the bottom and top.

33 Claims, 7 Drawing Figures

METHOD FOR IN SITU RECOVERY OF LIQUID AND GASEOUS PRODUCTS FROM OIL SHALE DEPOSITS

CROSS REFERENCE TO RELATED APPLICATIONS

This is a continuation of application Ser. No. 716,583, filed Aug. 23, 1976, now abandoned; and which is a continuation-in-part of U.S. patent application, Ser. No. 505,363, filed Sept. 12, 1974, now abandoned.

BACKGROUND

This application relates to the retorting and recovery of liquid and gaseous products from subterranean deposits containing oil shale for the production of carbonaceous products including shale oil.

This application is also related to U.S. patent application Ser. No. 603,704, entitled "In Situ Recovery of Shale Oil" filed Aug. 11, 1975, now U.S. Pat. No. 4,043,595 by Gordon B. French. The disclosure of this latter application is hereby incorporated by reference.

The term "oil shale" as used in the industry is, in fact, a misnomer. It is neither shale nor does it contain oil. It is a sedimentary formation comprising marlstone deposits interspersed with layers containing an organic polymer called "kerogen" which upon heating decomposes to produce carbonaceous liquid and gaseous products. A variety of other minerals are contained in this deposit. It is the deposit containing kerogen that is called "oil shale" herein and the carbonaceous liquid product is called "shale oil".

One technique for recovering shale oil is to form an in situ oil shale retort in a subterranean deposit containing oil shale. A void is excavated within the site of an situ oil shale retort being formed. At least a portion of the deposit within the boundaries of the in situ oil shale retort site is explosively expanded toward the void to form a fragmented permeable mass of particles containing oil shale in the in situ oil shale retort. The fragmented mass is ignited near the top to establish a combustion zone and oxygen supplying gas is introduced in the top of the retort to sustain the combustion zone and cause it to advance downwardly through the fragmented permeable mass of particles in the retort.

As burning proceeds the heat of combustion is transferred by flowing gas to the fragmented permeable mass of particles containing oil shale below the combustion zone to release shale oil and gaseous products therefrom in a retorting zone. Thus, a retorting zone advances from top to bottom of the retort in advance of the combustion zone and the resulting shale oil and gaseous products pass to the bottom of the retort for collection and removal. Other retorting fluids such as preheated gas can be employed for retorting oil shale in the fragmented mass.

In preparation for the retorting process, it is important that the deposit containing oil shale be fragmented rather than simply fractured to create sufficient permeability that undue pressures are not required to pass gas through the retort. Otherwise, gas passed through the retort must have a high differential of pressure between the top and bottom, which consumes a large amount of power.

It is also significant that retorting gas be introduced to the top of the retort in a manner that minimizes channeling of gas flow through the fragmented mass in the retort. When a large area of oil shale, deposit is being exploited a comprehensive system of underground workings is desirable to permit access to the retorts being formed and the operating retorts for introduction of retorting gas, excavation of deposit to form voids, explosive expansion of deposit in the retort sites to form additional fragmented masses and for recovery of liquid and gaseous products from the retorts. Safety, convenience and economy of operation are considered.

BRIEF SUMMARY OF THE INVENTION

Thus, in practice of one aspect of this invention a tunnel is formed at a level above an in situ oil shale retort containing a fragmented permeable mass of particles containing oil shale. A sloping passage is formed between the tunnel and the top of the fragmented mass and a retorting gas introduced from the tunnel through this passage into the retort for retorting gaseous and liquid products from the fragmented mass containing oil shale. Liquid and gaseous products are recovered from the bottom of the retort.

Principles of this invention are employed in recovering liquid and gaseous products from a plurality of adjacent retorts each containing a fragmented permeable mass of deposit containing oil shale. The tops of the retorts lie approximately at the same upper level and the bottoms lie approximately at the same lower level. A network of interconnecting tunnels is formed adjacent an end of the retort for access to the retorts. The tunnel system has a plurality of main access tunnels connected to one end of the retorts and a peripheral tunnel joined to the ends of the main access tunnels.

DRAWINGS

These and other features and advantages of the present invention will be appreciated as the same becomes better understood by reference to the following detailed description when considered in connection with the accompanying drawings wherein:

FIG. 4 is a top sectional view of a large area of an oil shale deposit of which FIGS. 1 to 3 are a portion;

DESCRIPTION

Figure 3:
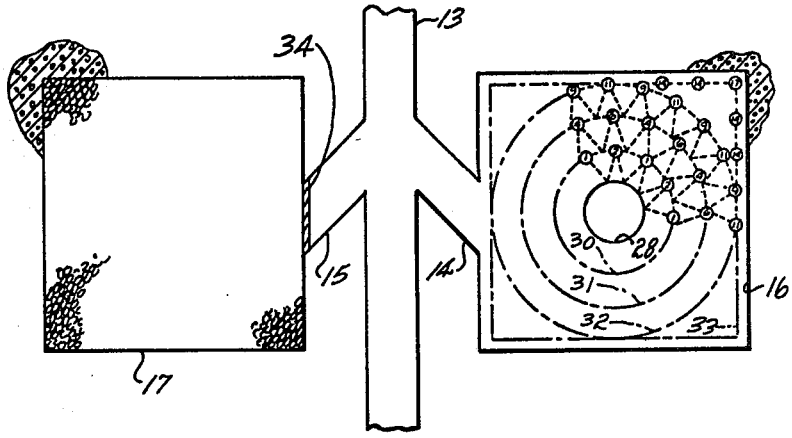
FIG. 3 is a top sectional view of the retorts illustrated in FIG. 1.
Figure 1:
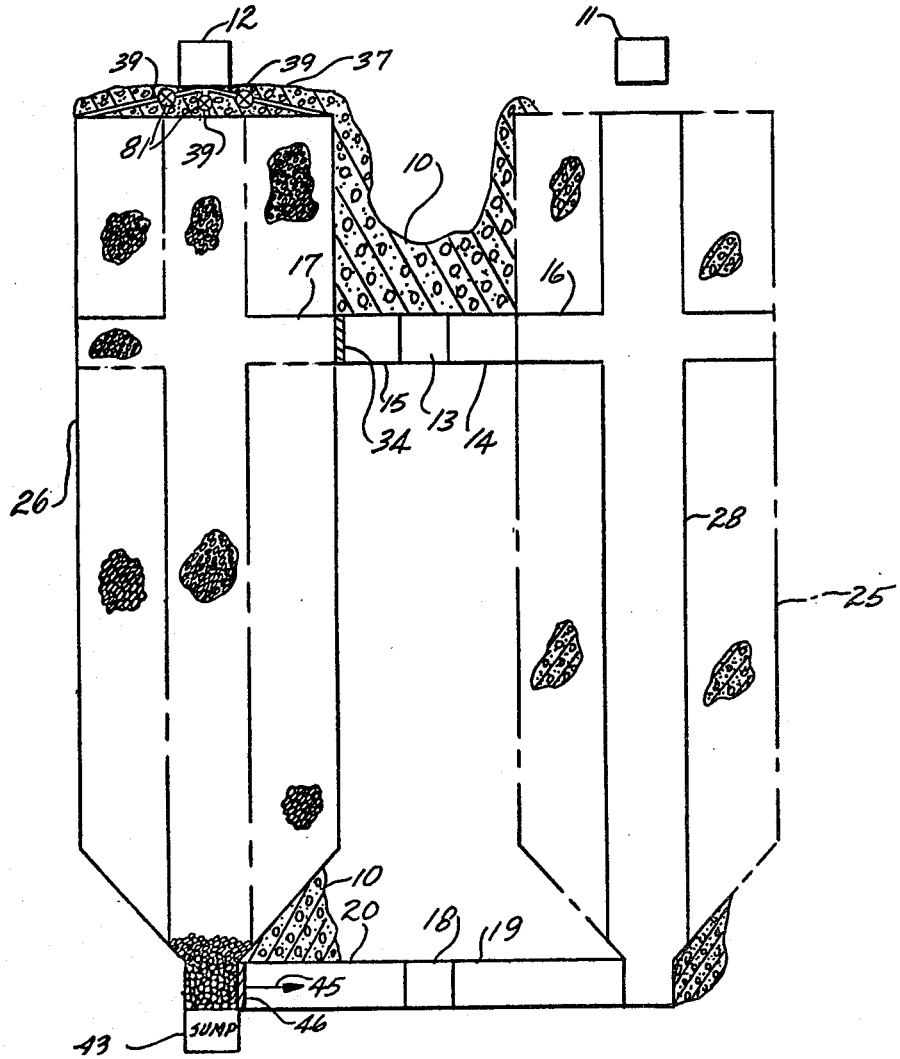
FIG. 1 is a semi-schematic, north facing, side sectional view of a pair of in situ oil shale retorts in a subterranean oil shale deposit.

Reference is made to FIGS. 1 to 3 which depict a portion of a subterranean deposit or formation 10 containing oil shale and two in situ retorts formed in the deposit. Parallel tunnels or drifts 11 and 12 are excavated in a north-south direction at an upper level or air level in the deposit. This upper horizontal level is hereafter designated level "A". It will be understood that description of the tunnels 11 and 12 as being in a north-south direction is merely a matter of convenience for purposes of exposition. These tunnels and other structures described hereinafter can have any desired azimuth.

A main tunnel 13, branch tunnels or drifts 14 and 15, and work rooms 16 and 17 are excavated at an intermediate horizontal level of the deposit 10, hereinafter designated as level "B". The main haulage tunnel 13 at the intermediate level also extends in a north-south direction and it is midway between the "A" level tunnels 11 and 12 in an east-west direction. The work rooms 16 and 17 each have a square floor plan and lie on opposite sides of the main tunnel 13 directly under the "A" level tunnels 11 and 12, respectively, such that the diagonals of the floor plans of room 16 and 17 intersect directly below the "A" level tunnels 11 and 12, respectively. Intermediate level drifts 14 and 15 extend at an angle of about 45° from the intermediate main tunnel 13 to the work rooms 16 and 17, respectively, to facilitate access thereto with large pieces of equipment.

A main tunnel 18 and branch drifts 19 and 20 are formed at a lower level or production level in the deposit 10, hereinafter designated level "C". The lower level tunnel 18 is parallel to and lies directly under the intermediate, or "B" level, tunnel 13. Diagonal drifts 19 and 20 extend at an angle of about 45° from the lower level tunnel 18 for ease of equipment access to a location directly under the "A" level tunnel 11 and a location directly under the "A" level tunnel 12, respectively. These locations at the ends of the diagonal drifts 19 and 20 are directly beneath the work rooms 16 and 17, respectively.

The various tunnels, drifts and work rooms at levels "A", "B", and "C" are excavated by conventional mining techniques. Communication between ground level and levels "A", "B", and "C", is established by one or more shafts or adits (not shown in FIGS. 1 to 3). In a working embodiment the upper "A" level and lower "C" level can be located at the top and bottom of the deposit containing oil shale or at least at the upper and lower workable levels thereof. Intermediate level "B" is closer to the upper level "A" than to the lower level "C" so that the overhead drilling and explosive loading distance is smaller than the distance in a downward direction in which blasting holes are drilled and loaded.

The various tunnels and drifts mentioned above are preferably self-supporting, that is, they are narrow enough that their roofs or "backs" do not subside in the absence of support pillars within the tunnel or drift.

In a working embodiment the tunnels and drifts are about 30 feet high and 30 feet wide. The work rooms 16 and 17 are about 120 feet wide, 120 feet long, and 30 feet high. The vertical distance from level "A" to level "B" is about 200 feet. The vertical distance from level "A" to level "C" is about 570 feet.

Figure 2B:
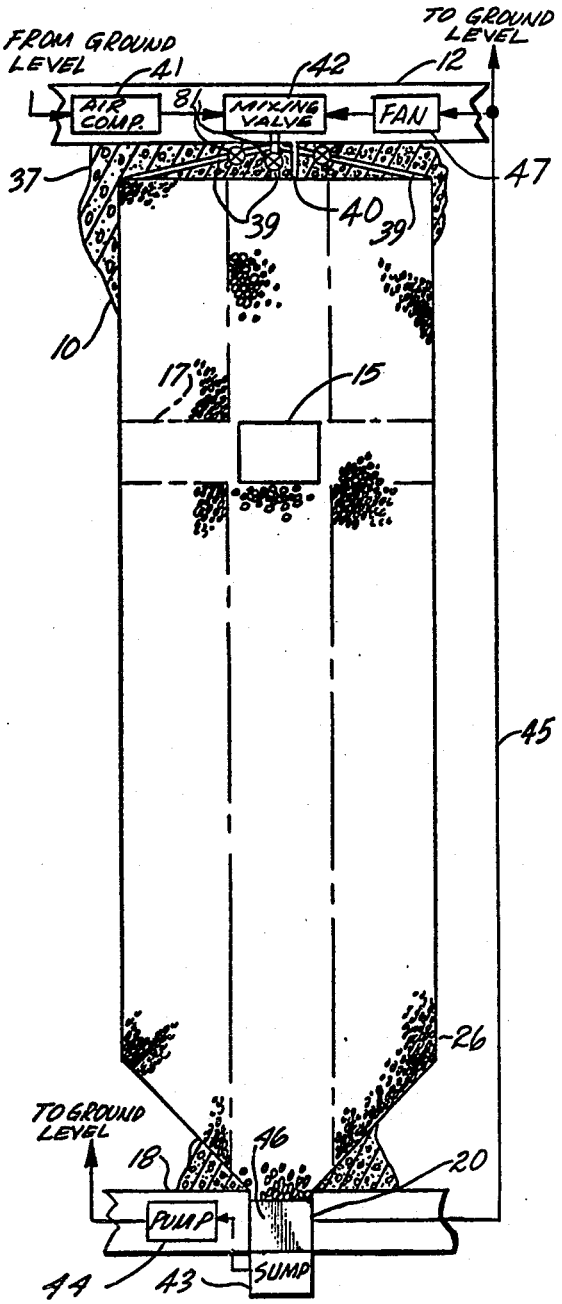
FIGS. 2A and 2B are, respectively, east facing and west facing side sectional views of the retorts of FIG. 1.
Figure 2A:
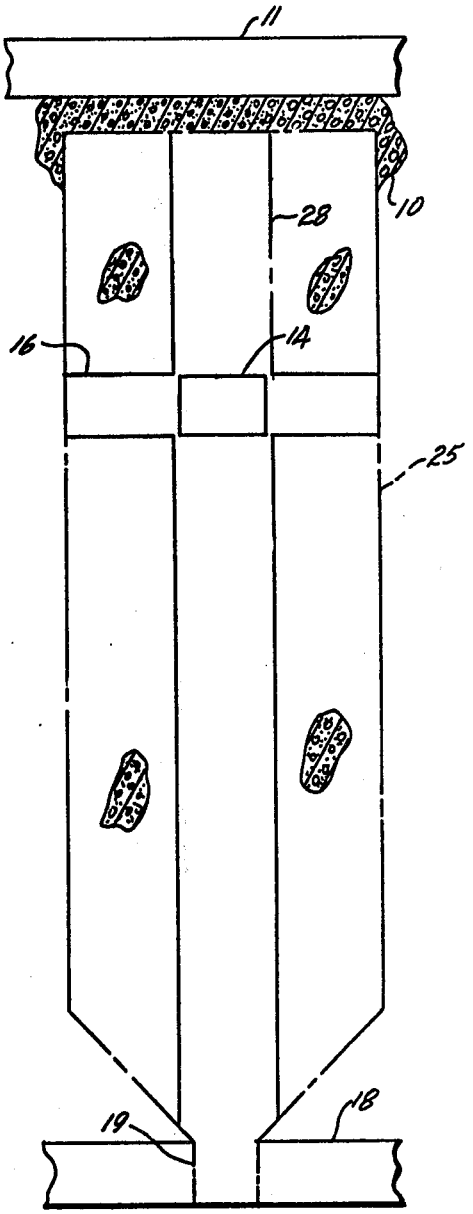

An in situ oil shale retort site 25 is depicted prior to fragmentation of a portion of the deposit by phantom lines in FIGS. 1 and 2A. Another in situ oil shale retort 26 is depicted after fragmentation by solid lines. A portion of deposit containing oil shale within the retort sites 25 and 26, which comprise volumes of deposit approximately defined by the floor plans of the work rooms 16 and 17, respectively, and a distance a little less than that between levels "A" and "C", is fragmented to form a permeable mass of particles of deposit containing oil shale. Gaseous and liquid products, including shale oil, are recovered from the fragmented permeable mass in situ.

Practice of this invention involves formation of the tunnels at level "A" and formation of tunnels, drifts and work rooms at level "B" and connection of tunnels to the retort site. Other aspects of the formation of the in situ oil shale retorts are described to complete the disclosure of a specific embodiment illustrating this invention. The technique for fragmenting deposits containing oil shale within the in situ oil shale retorts described herein is but one of a number of techniques that can be employed, including, for example, those disclosed in U.S. Pat. No. 3,611,423, and the aforementioned patent applications.

To prepare the in situ oil shale retort 25 for fragmentation a vertically extending raise or columnar void 28 is excavated from the middle of the work room 16 upwardly to a location spaced from the bottom of the overlying tunnel 11 at the "A" level. A columnar void is also excavated below the middle of the work room 16 to intercept the "C" level drift 19. In a working example the columnar void 28 is a cylinder with a diameter of about 58 feet. If desired, the columnar void 28 can be non-cylindrical, for example, a square void extending upwardly and downwardly from the work room.

One way of forming the columnar void 28 is to blast it out in its full cross section in a series of vertical increments progressing upwardly from the "C" level tunnel 19 towards the work room 16 and upwardly from the work room 16 towards the "A" level tunnel 11. To permit the rubble resulting from the blasting to flow freely to the work room 16 and the "C" level drift 19 for removal, the height of each blasted increment should be less than about 0.95 of the smallest cross-sectional dimension of the columnar void, that is, the diameter of the cylindrical void 28. Thus, for the dimensions of a working embodiment as mentioned above, the height of each increment removed would be about 55 feet or less. To remove each increment a plurality of blasting holes are drilled in the portion of the deposit to be removed. These blasting holes are loaded with explosive which is detonated and the resulting debris falls to the work room 16 and/or "C" level drift 19 from which it is removed. Such an enlargement step is repeated until the desired height for the columnar void 28 is attained.

Another way of forming the columnar void is to blast it out in its full length in a series of annular increments progressing from the center outwardly. An initial vertical raise of small diameter is formed from the middle of the work room 16 upwardly toward the "A" level tunnel 11 and between the "C" level drift 19 and the work room by drilling, boring, etc. This initial raise is enlarged by drilling a ring of vertical blasting holes around the initial raise over its entire length. The blasting holes are loaded with explosive which is detonated and the resulting debris is removed at the "C" level by way of the drift 19. The cross-sectional area of the ring of blasting holes around the original raise should be such that the cross-sectional area of the original raise is about 18% or more of the cross-sectional area of the ring. Otherwise the debris from blasting can freeze in place, that is, it may not flow freely down into the drift 19 for removal. Such enlargement of the small diameter raise is repeated as many times as needed to increase the diameter of the columnar void to the final diameter in increments that will permit free flow of the blasting debris down into the drift 19 in each instance.

Objectives of the fragmentation of deposit in the in situ oil shade retort are to maximize permeability while minimizing the void fraction of the fragmented mass of deposit. A high permeability is desirable to permit passage of gas through the in situ oil shale retort without an undue pressure drop which would entail significant power consumption. A small void fraction is desirable to minimize the quantity of deposit mined, since this is expensive to remove, and to maximize the quantity of oil shale retorted, which increases the total recovery of shale oil. Uniformity in a horizontal plane is also an objective since it minimizes channeling in the flow of gases through the retort which can impair the effectiveness of the retorting process.

The void fraction of most of the fragmented mass of deposit containing oil shale depends upon the ratio of the cross-sectional area of the columnar void 28 to the horizontal cross-sectional area of the in situ retort 25, which is approximately the same as the area of the floor plan of the work room 16. Thus, to control the void fraction, one selects the diameter for the cylindrical columnar void 28. There is a minimum value of void fraction beyond which is permeability of the fragmented shale increases sharply. Below the minimum value of the void fraction the shale fractures without fragmenting. In other words fissures are formed in the deposit but the oil shale freezes in place, so to speak; it does not actually break up and move appreciably. Above the minimum value of void fraction the deposit within the retort moves appreciably and breaks up into individual fragments or particles with interstitial voids, thereby creating high permeability.

In a preferred embodiment the deposit containing oil shale surrounding the columnar void 28 in the in situ oil shale retort site 25 is explosively expanded in a plurality of concentric annular layers progressing outwardly in rapid sequence. Each layer is completely severed from the adjoining deposit to form a free face on the deposit prior to severance of the next layer. In an experiment in which the cross-sectional area of a columnar void was approximately 18% of the horizontal cross-sectional area of the retort, the horizontal cross section of the retort was about 1000 square feet, and the vertical height of the retort was about 80 feet, it was found that the oil shale deposit fragmented well throughout and about 1 psi pf pressure differential was required to achieve an approximately horizontally uniform gas flow rate of about 1200 scfm from top to bottom of the retort. Generally, the void fraction should be large enough to cause a pressure drop in gas flowing through the retort of less than about 5 psi. Although the minimum void fraction consistent with this pressure differential has not been experimentally verified, it is believed to be approximately 8%; that is, the columnar void should have a cross-sectional area that is greater than about 8% of the horizontal cross-sectional area of the in situ oil shale retort.

If the void fraction is too small, the outer layers of deposit in the retort do not have enough room to expand so they fracture instead of fragmenting. As a result, horizontally uniform permeability is not achieved and explosive used for the outer layers of shale is not effectively utilized. If the void fraction is too large, needless expense is incurred to mine shale to create the void space towards which the deposit is expanded. Therefore, to achieve a favorable balance between high, horizontally uniform permeability and desirably low void fraction, the cross-sectional area of the columnar void is preferably between about 8% and 20% of the cross-sectional area of the retort. If the void fraction exceeds about 40% the fragmented mass of particles can fail to completely fill the space within the retort and therefore would not offer support for the overburden. For this reason about 40% is considered an upper limit on the void fraction although the mining expense can become prohibitive below 40% void fraction.

To prepare the region of deposit remaining within the in situ oil shale site around the columnar void 28 for explosive expansion, concentric rings 30, 31, and 32 of vertical blasting holes are drilled upwardly and downwardly from the work room 16 along the length of the columnar void. Although three rings are described and illustrated herein, more or less could be employed depending on the dimensions of the working embodiment. A closed square border 33 of vertical blasting holes assures fragmentation in the corners of the portion of the deposit explosively expanded. The border 33 defines the horizontal cross-section area of the retort.

Less than all of the blasting holes are represented in FIG. 3 which is intended to be semi-schematic to illustrate the arrangement, if not the placing of the blasting holes. In practice it is not possible to drill the blasting holes in the border 33 precisely along the edges of the work room 16 so the horizontal cross-sectional dimensions of the retort, e.g. 117 feet by 117 feet, can be slightly smaller than the dimensions of the work room, e.g. 120 feet by 120 feet.

The bottom of the in situ oil shale retort 26 is funnel-shaped so as to improve distribution of gases flowing through the fragmented mass and into the diagonal drift 20 on level "C". Thus, the blasting holes in the rings 30, 31, and 32 and the border 33, respectively, are incrementally shorter in length than the columnar void so as to provide the desired slope for the bottom of the in situ oil shale retort.

It is found that the deposit will fracture without fragmenting if the distance from the blasting holes to the free face toward which the deposit is expanding, hereinafter called the blasting distance or burden distance, exceeds a certain limiting value. In the case of the innermost ring 30 of blasting holes the blasting distance extends from the ring 30 to the free surface of the columnar void 28. In the case of the intermediate ring 31 of blasting holes, the blasting distance is the distance between ring 31 and the free face created at the innermost ring 30 upon blasting. In the case of outermost ring 32 of blasting holes the blasting distance extends from the ring 32 to the free face created at the intermediate ring 31 upon blasting. The limit on blasting distance depends on the diameter of the blasting holes. For example, if the diameter of the blasting holes is about 3 inches, the limit is about 10 feet. If the diameter of the blasting holes is about six inches, the limit is about 15 feet.

The blasting holes are distributed so that the sides of imaginary triangles formed between adjacent holes in each ring and an intermediate point on the free face toward which the ring is expanding, e.g. an adjacent ring, represented in FIG. 3 by dashed lines, do not exceed the limit on the blasting distance.

Within each ring, the spacing between adjacent blasting holes, known as the spacing distance, also depends on the diameter of the blasting holes. Ordinarily it is considered that the spacing distance is greater than the blasting distance. Thus, the number of rings and the number of blasting holes in each ring depend on the cross-sectional area of the in situ oil shale retort and the diameter of the blasting holes.

The blasting holes are loaded throughout their length with explosive such as dynamite or ammonium nitrate mixed with fuel oil. In the latter case one can fragment about six net tons of oil shale per pound of explosives. Explosive in the blasting holes is blasted in an outward progression from the columnar void 28 in the following sequence of steps:

(a) ring 30, (b) ring 31, (c) ring 32, (d) border 33, with the exception of the corner holes, and (e) the corner holes of border 33.

On the one hand, the time delay between each of the above steps is sufficiently large, e.g. 100 to 150 miliseconds, to permit the layer of deposit created by detonanting explosive in blasting holes in each ring to completely break away from the remaining deposit surrounding it, thereby creating a new free face, prior to detonation of explosive in the next ring of blasting holes. This assures that the oil shale does not fracture without fragmenting. On the other hand, the time delay between each of the above steps is not so large that the layers of shale fall appreciably before the blasting sequence is completed. This helps assure that the fragmented mass is not more tightly packed near bottom of the retort than it is near the top.

In summary, by blasting the portion of deposit remaining in the in situ retort site in a single round of a short sequential series of explosions, the time delay between the steps of the sequence is such that the deposit surrounding the columnar void expands inwardly in layers to fill the available space without expanding appreciably in a downward direction.

Within each ring there is a small time delay, e.g. 50 to 100 milliseconds, between detonation of explosive in alternate holes to cause the deposit to break up vertically in the vicinity of the holes. This provides good fragmentation. The detonators for the explosive in the blasting holes employ delay fuses that are triggered simultaneously. The numbers of these delay fuses are indicated in FIG. 3 inside the circles indicating the respective blasting holes. As measured from the instant of triggering the fuses the following correspondence between fuse number and time delays exists:

| Fuse Number | Time Delay |
|---|---|
| No. 1 | 25 milliseconds |
| No. 2 | 50 milliseconds |
| No. 4 | 100 milliseconds |
| No. 6 | 170 milliseconds |
| No. 9 | 280 milliseconds |
| No. 11 | 320 milliseconds |
| No. 14 | 500 milliseconds |
| No. 17 | 700 milliseconds |

Prior to detonation of explosive in the rings 30, 31, and 32, and the border 33, a portion of the rubble or fragmented deposit removed in the course of formation of the void spaces within the in situ oil shale retort can be returned to the work room 16 to increase the quantity of retorted oil shale and minimize the void toward which deposit adjacent the work room can expand.

After explosive expansion of the deposit in the retort site into the columnar void 28 and work room 16, the retort 25 appears as the retort 26 in the drawings, which is ready for the retorting process in which gaseous and liquid products are recovered from the permeable mass of particles containing oil shale. In a working embodiment the region between the top of the fragmented mass and about level "B" and the region between about level "B" and the funnel-shaped bottom of the retort have a void fraction of about 18%; that is, a void fraction determined by the ratio of the cross-sectional area of the columnar void to the horizontal cross-sectional area of the retort. The funnel-shaped region at the bottom of the retort and the region near the work room at level "B" have a void fraction in excess of about 18%. In FIGS. 1 and 2B the former location of work room 17 and the columnar void of the retort 26 are indicated by phantom lines since these spaces are filled by the fragmented deposit created by explosive expansion.

A horizontal pillar 37 of unfragmented shale remains between the top of the in situ oil shale retort 26 and the overlying air level tunnel 12. The fragmented mass of particles completely fills the top of the retort 26 thereby providing support for the horizontal pillar 37.

A plurality (e.g. five) of air supply holes or passages 39 are drilled or otherwise excavated from the "A" level tunnel 12 to distributed locations at the top of the retort 26 (e.g. near the four corners and the center in the form of a quincunx). One of the air supply holes can extend directly down from the tunnel to the center of the top portion of the fragmented mass in the retort. The other air inlet holes slope from the overlying tunnel to the top portion of the retort nearer the corners. The air supply holes 39 have diameters of 4 to 7 feet for minimizing pressure losses.

It is desirable to test the flow resistance of the fragmented mass in the retort 26 for uniformity. If the flow resistance of some paths through the retort is higher than others, the effective sizes of the holes 39 overlying such paths can be selectively changed as by adjustable louvers 81 (shown schematically in FIGS. 1 and 2B) within such holes to compensate, thereby equalizing the flow along various paths through the fragmented mass in the retort.

A hole 40 is drilled or otherwise excavated from the "A" level tunnel 12 to the top of the fragmented mass in the retort 26. This hole 40 can have a diameter of about 4 to 10 feet. A burner (not shown) is lowered through the hole 40 to near the top of the fragmented mass in the retort and fuel is burned for igniting the fragmented mass containing oil shale. If desired the retort can be ignited through the air inlet passages 39. Air under pressure is conveyed from an air compressor or blower 41 located in the "A" level tunnel 12 or at ground level through a mixing valve 42 and inlet holes 39 to the top of the fragmented mass in the retort 26 to sustain a combustion zone in the fragmented mass.

The "C" level drift 20 is exposed to the fragmented mass at the bottom of the retort 26. A sump 43 is located in the drift 20 at a low point for recovering liquid products including shale oil and water. Depending on the slope of the drift 20 special grading and/or drainage ditches can be provided prior to explosive expansion of deposit in the in situ oil shale retort in order to drain the liquid products to the sump 43. A pump 44 conveys shale oil from the sump 43 to ground level.

A conduit 45 conveys a portion of the retorting off gas withdrawn from the retort from a sealed bulkhead 46 in the "C" level drift 20 to the mixing valve 42 by way of a fan or blower 47 located in the "A" level tunnel 12. The balance of the off gas can be used for generating electrical power in the "A" level tunnel for utilization in compressing the air introduced from ground level or can be conveyed to ground level and burned for generating electrical power.

As described in U.S. Pat. No. 3,661,423, carbonaceous material in the fragmented mass of particles containing oil shale in the retort is burned with a combustion zone advancing downwardly. Air or other oxygen supplying gas introduced near the top of the fragmented mass sustains the combustion zone and causes it to advance downwardly through the fragmented mass. Oxygen in the air or other inlet gas combines with carbonaceous material in the oil shale to yield combustion gases which, along with unreacted portions of the inlet gas, flow downwardly through the fragmented mass carrying heat of combustion. Heat carried down from the advancing combustion zone establishes a retorting zone on the advancing side of the combustion zone wherein the fragmented mass is heated. Kerogen in the oil shale decomposes to produce gaseous and liquid products including shale oil. Gaseous products mix with combustion gas and unburned portions of the inlet gas. Such gases along with products of carbonate decomposition and water vapor pass through the fragmented mass to the bottom of the retort and are withdrawn as off gas.

Liquid products including shale oil percolate downwardly through the retort to the "C" level drift 20 where they collect in the sump 43 for recovery. Off gas is withdrawn by way of the conduit 45 through the "C" level drift 20. A portion of the off gas is conveyed to the fan 47 for recycling through the mixing valve 42 to reduce the oxygen concentration of air introduced at the top of the retort. The mixing valve 42 controls the mixture ratio between air and recycled off gas. Excess off gas is conveyed to ground level.

In a working example after explosive expansion the retort contains a fragmented permeable mass of deposit particles containing oil shale weighing about 243,000 tons available for retorting. The air compressor blower 41 supplies about 16,500 standard cubic feet per minute (scfm) of air, and about 12,300 scfm of off gas is recycled with the result that a total of about 29,000 scfm of mixed inlet gas flows through the mixing valve 42 into the top of the fragmented mass in the retort. Burning in the combustion zone and decomposition of kerogen in the retorting zone plus carbonate decomposition and release of water vapor contribute to off gas withdrawn at the rate of about 35,000 scfm from the bottom of the retort. About 22,000 scfm of the off gas is vented to the atmosphere, flared or burned to generate electricity, and the remainder of the off gas is recycled. Conversion of the withdrawn off gas to electrical power by way of heat yields about 15,000 to 20,000 kilowatt hours. A retorting rate of about 2 feet per day with an average daily production of about 450 barrels of shale oil results.

Figure 4:
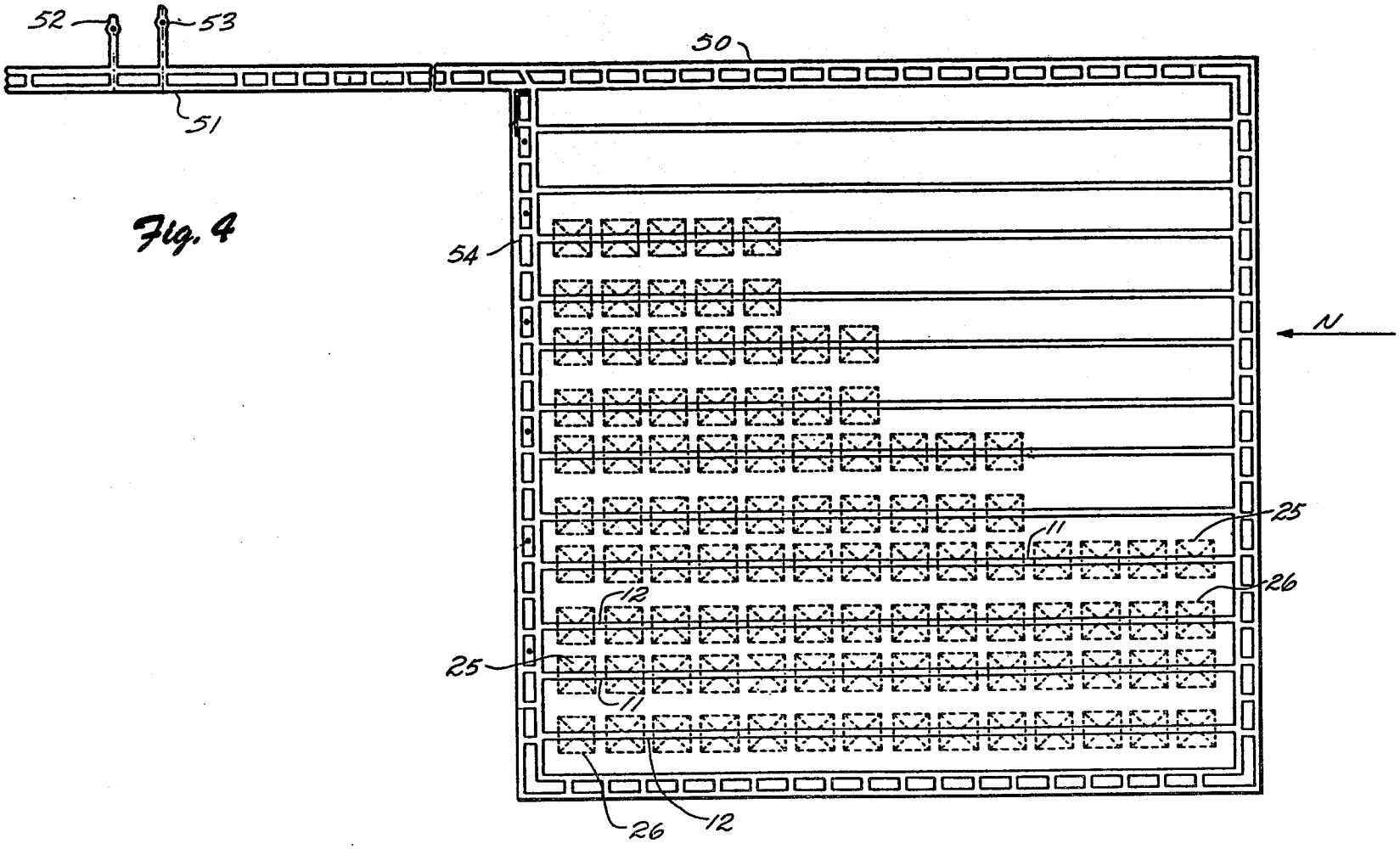
Figure 5:
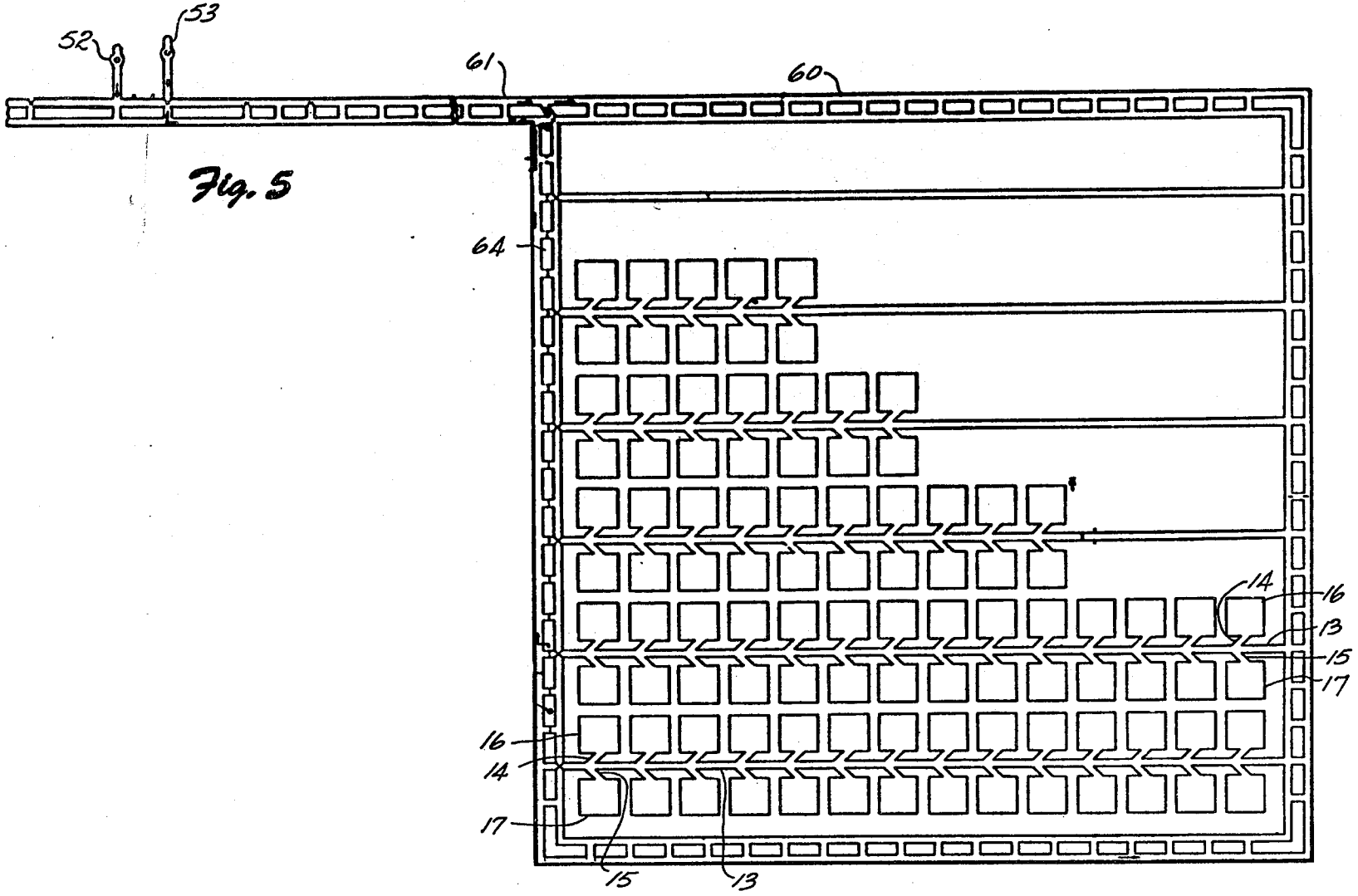
FIG. 5 is a top sectional view of the area of FIG. 4 at a lower elevation.
Figure 6:
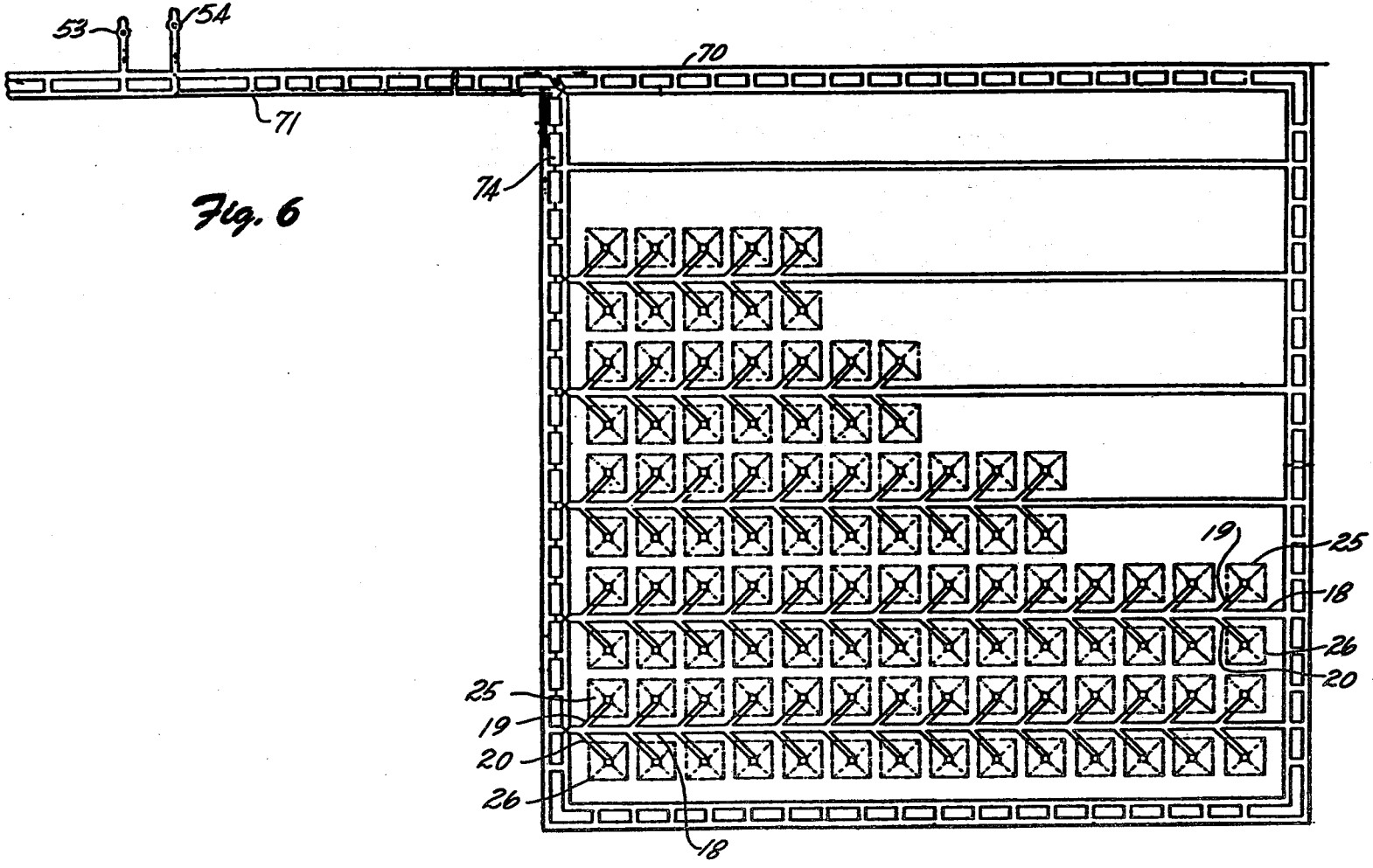
FIG. 6 is a top sectional view of the area of FIG. 4 at a still lower elevation.

Reference is made to FIGS. 4 to 6 for floor plans of levels "A", "B", and "C" respectively of a portion of a deposit containing oil shale being exploited in practice of this invention. FIGS. 1 to 3 represent a portion of this larger array. North is indicated by an arrow in FIG. 4. The excavations on level "A" are depicted in FIG. 4. In situ oil shale retorts 25 and 26 are arranged in a grid or array of horizontal rows and columns. Six rows of retorts 25 and six rows of retorts 26 are alternated. The grid has 14 columns of retorts 25 and 26. A double entry peripheral tunnel system 50 extends around and at a level above the grid of retorts in a rectangular path. A plurality of main tunnels 11 which extend directly over the respective rows of retort 25 join the peripheral tunnel system 50 along opposite sides thereof. Similarly a plurality of main tunnels 12 which extend over respective rows of retorts 26 join the peripheral double entry tunnel system along opposite sides thereof.

At one corner of the peripheral tunnel system 50 a pair of connecting tunnels or drifts 51 lead to a service shaft 52 and a production shaft 53 which extend vertically downwardly from ground level to the lowermost level "C". (In other embodiments the connecting tunnel 51 can be an adit leading to ground level at an outcrop.)

A purpose of level "A" is to provide access to the top of the retorts for burners which ignite the fragmented mass containing oil shale, to convey air under pressure and/or recycled off gas to the tops of the retorts having combustion zones therein, and to house the mixing valves that control the ratio of air and off gas introduced into the tops of the retorts. In addition, level "A" can house an electrical generator powdered by burning withdrawn off gas after scrubbing and an air compressor blower driven by the generator. The products of combustion resulting from the electrical generation can be conveyed by way of the production shaft 53 to ground level.

FIG. 5 depicts excavations at level "B". Work rooms 16 and 17 which correspond in floor plan to the horizontal cross sections of retorts 25 and 26 respectively are arranged in a grid of alternating rows and columns as hereinabove described in connection with FIG. 4. A double entry peripheral tunnel system 60 extends around the grid of work rooms 16 and 17 in a rectangular path. Main tunnels 13 which extend between the respective rows of work rooms 16 and 17 join the peripheral tunnel system 60 along opposite sides thereof. Diagonal branch drifts 14 and 15 interconnect the main tunnels 13 with work rooms 16 and 17 respectively. A pair of connecting tunnels 61 lead from one corner of the peripheral tunnel system 60 to the service shaft 52 and production shaft 53.

A purpose of level "B" is to provide access to the retorts to form the columnar voids 28 and to form and load blasting holes for explosively expanding the deposit in the retort sites. The height of the tunnels and rooms at level "B" is dictated by space requirements of the equipment employed to perform these operations.

FIG. 6 depicts excavations at the lower level "C". Retorts 25 and 26 are arranged in a grid of alternate rows and columns as described in connection with FIG. 4. A double entry peripheral tunnel system 70 extends around and below the grid of retorts in a rectangular path. Main tunnels 18 which extend between and at a level below the respective rows of retorts 25 and 26 join the peripheral tunnel system 70 along opposite sides thereof. Diagonal branch drifts 19 and 29 interconnect the main tunnels 18 with the columnar void 28 of each retort. A pair of connecting tunnels 71 lead from one corner of the peripheral tunnel system 70 to the service shaft 52 and production shaft 53. A purpose of level "C" is to remove fragmented deposit during formation of the columnar voids 28. Level "C" also serves for recovery of liquid products including shale oil and water from the bottoms of the retorts. Off gas is also withdrawn from the bottoms of the retorts at level "C" during retorting operations.

Although it is convenient for levels "A", "B", and "C" to be horizontal, and the columnar voids 28 to be vertical, the levels, particularly level "B" can be sloped somewhat to conform to the dip of the deposit, and the columnar voids can be appropriately tilted. Preferably the retorts have rectangular horizontal cross sections to completely work the deposit containing oil shale with a minimum of unprocessed oil shale remaining in situ. The floor plan of the work rooms at level "B" corresponds to the horizontal cross section of the retorts since their purpose is for preparation of the deposit in the rotort sites for fragmentation. The azimuthal orientation of the tunnels and work rooms is only employed for convenience of exposition. The actual orientation depends on a variety of factors affecting convenience and efficiency.

If a very thick deposit containing oil shale is being worked it can be desirable to provide more than the three levels of excavation indicated above. Specifically more than one "B" level can be provided to minimize the length of blasting holes in which explosive is loaded and the length of uphole explosive loading. Drilling and explosive loading in a downward direction are easier than in an upward direction. In the case of multiple "B" levels uphole drilling and explosive loading are avoided in all but the highest of the "B" levels. Thus, as the height of the retort increases and more "B" levels are added there is less uphole drilling and loading required as a percentage of the volume of the retort.

The described embodiment of this invention is only considered to be preferred and illustrative of the inventive concepts. The scope is not to be restricted to such embodiment. Various and numerous other arrangements may be devised by one skilled in the art without departing from the spirit and scope of this invention.

What is claimed is:

1. A method for recovering carbonaceous values from a subterranean oil shale deposit, comprising the steps of:

forming a plurality of adjacent in situ oil shale retort containing fragmented permeable masses of oil shale separated by partitions of unfragmented oil shale, the retorts being arranged in rows and columns such that their top end boundaries lie approximately at the same level and their bottom end boundaries lie approximately at the same level;

introducing into the top of the respective retorts from a first means of access a retorting fluid that serves to release the carbonaceous values from the oil shale and to transport the carbonaceous values to the bottom of the respective retorts;

removing the carbonaceous values from the bottom of the respective retorts through a second means of access; and forming as one of the means of access a network of interconnecting tunnels at a level directly adjacent to one of the end boundaries of the retorts, the network comprising a plurality of rows of main tunnels connected to the one end boundary of the rows of retorts and a peripheral tunnel completely surrounding and joined to the ends of the main tunnel to provide access to both ends of each main tunnel.

2. The method of claim 1 in which the network of tunnels is the first means of access and is adjacent to the top end boundary of the retorts.

3. The method of claim 2 in which the removing step comprises forming as the second means of access a further network of interconnecting tunnels adjacent to the bottom boundary of the retorts, the further network of tunnels comprising a plurality of further rows of main tunnels connected to the bottom boundaries of the further rows of retorts, and a peripheral tunnel completely surrounding and joined to the ends of the main tunnels to provide access to both ends of each main tunnel.

4. The method of claim 1 in which the network of tunnels is the second means of access and is adjacent to the bottom end boundary of the retorts.

5. The method of claim 1 in which the network of tunnels lies at a level directly above to top end boundary of the retorts and the rows of main tunnels are equal in number to and aligned with the rows of retorts.

6. The method of claim 1 in which the network of tunnels lies directly below the bottom boundary of the retorts and the rows of main tunnels are fewer in number and disposed between the rows of retorts.

7. A method for recovering carbonaceous values from a subterranean oil shale deposit comprising the steps of:

fragmenting the shale in an in situ oil shale retort to form a permeable mass of shale;

forming a tunnel that extends directly above the retort in spaced relationship therefrom;

forming a passage between the tunnel and the top of the retort;

lowering an igniter through the passage from the tunnel to the top of the retort to ignite the fragmented shale;

transporting atmospheric air from ground level to the tunnel;

compressing the transported air in the tunnel;

coupling the compressed air into the top of the retort for combustion of the ignited shale;

removing carbonaceous values including off gas from the bottom of the retort;

transporting a portion of the off gas from the bottom of the retort to the first tunnel;

mixing a first portion of the transported off gas and the compressed air together in the tunnel prior to introduction into the retort;

generating electrical power in the tunnel from a second portion of the transported off gas; and utilizing the generated electrical power to compress the transported air in the tunnel.

8. The method of claim 7, additionally comprising the steps of transporting the remainder of the off gas to ground level, and generating electrical power from the remainder of the off gas at ground level.

9. A method for recovering liquid and gaseous products from an in situ oil shale retort containing a fragmented permeable mass of particles containing oil shale in a subterranean oil shale deposit comprising the steps of:

forming a tunnel at a level above the top of the retort leaving unfragmented deposit between the tunnel and the top of the fragmented mass in the retort;

forming at least one sloping gas inlet passage from the tunnel to the top of the retort;

introducing a gas into the top of the retort through such a sloping passage for retorting liquid and gaseous products from oil shale in the fragmented mass; and removing the liquid and gaseous products from the bottom of the retort.

10. A method as recited in claim 9 wherein a plurality of sloping gas inlet passages are formed from the tunnel to separate locations at the top of the retort.

11. A method as recited in claim 9 wherein the introducing step comprises introducing gas into the top of the retort through a plurality of passages to distributed locations at the top of the retort and adjusting the effective size of such passage for equalizing flow along various paths in the fragmented mass.

12. A method for recovering liquid and gaseous products from a subterranean oil shale deposit, comprising the steps of:

forming a plurality of adjacent in situ oil shale retorts in the deposit, each retort containing a fragmented permeable mass of particles of deposit containing oil shale having top end, bottom end and side boundaries of oil shale deposit, the retorts being arranged in rows and columns with the top end boundaries of the retorts at approximately the same upper level and the bottom end boundaries of the retorts at approximately the same lower level;

introducing into the top of the retorts from a first access means, a gas for retorting liquid and gaseous products from oil shale in the fragmented mass;

removing the liquid and gaseous products from the bottom of the retorts through a second access means; and forming as one of the access means a network of interconnecting tunnels at a level adjacent to one of the end boundaries of the retorts, the network comprising a plurality of rows of main tunnels connected to the one end boundary of the retorts and a peripheral tunnel completely surrounding and joined to the ends of the main tunnels to provide access to both ends of each main tunnel.

13. A method as recited in claim 12 wherein the main tunnels are connected to a double entry peripheral tunnel system.

14. The method of claim 12 wherein at least one passage is formed from a main tunnel to the top of each retort and gas is introduced into the retorts through the respective passages.

15. The method of claim 12 wherein a plurality of sloping passages are formed from a main tunnel to distributed locations at the top of each retort and gas is introduced into the retorts through the respective passages.

16. The method of claim 12 in which the network of interconnecting tunnels is the first access means and is adjacent to the top end boundary of the retorts.

17. The method of claim 16 comprising forming as the second access means a second network of interconnecting tunnels at a level adjacent to the bottom end boundary of the retorts, the second network of tunnels comprising a plurality of rows of lower level main tunnels connected to the bottom end boundary of the retorts, and a lower level peripheral tunnel completely surrounding and joined to the ends of the lower level main tunnel to provide access to both ends of each lower level main tunnel.

18. The method of claim 12 in which network of tunnels is the second access means and is adjacent to the bottom end boundary of the retorts.

19. The method of claim 12 in which the network of tunnels lies at a level above the top end boundary of the retorts and the rows of main tunnels are equal in number to and aligned with the rows of retorts.

20. The method of claim 12 in which the network of tunnels lies below the bottom end boundary of the retorts and the rows of main tunnels are fewer in number and disposed between the rows of retorts.

21. A method of forming, in a subterranean deposit containing oil shale, a plurality of in situ oil shale retorts having top end boundaries, bottom end boundaries and side boundaries of the deposit and containing fragmented deposit containing oil shale therein, said retorts being arranged in rows and columns comprising the steps of:

excavating first portions of the subterranean deposit to form an access and peripheral tunnel system for access to individual retort sites comprising a plurality of access tunnels at a level adjacent to the top end boundaries of said retorts being formed, and connecting passages leading from the access tunnel to such top end boundaries of the individual retorts and a peripheral tunnel completely surrounding the access tunnels and connecting the access tunnels;

excavating a second portion of the deposit from within the boundaries of such a retort site to form at least one void and leaving a third portion of said deposit, which is to be fragmented by expansion towards said void, within said boundaries; and explosively expanding said third portion of deposit toward said void.

22. A method as recited in claim 21 wherein the access tunnels are connected to a double entry peripheral tunnel system.

23. A method as recited in claim 21 wherein a plurality of sloping passages are formed from an access tunnel to distributed locatons at the top of each retort.

24. A method of forming, in a subterranean deposit containing oil shale, a plurality of in situ oil shale retorts having top end boundaries, bottom end boundaries and side boundaries of the deposit and containing fragmented deposit containing oil shale therein, said retorts being arranged in rows and columns comprising the steps of:

excavating first portions of the subterranean deposit to form an access and peripheral tunnel system for access to individual retort sites comprising a plurality of access tunnels at a level adjacent to the bottom end boundaries of said retorts being formed, and connecting drifts leading from the access tunnel to such bottom end boundaries of the individual retorts and a peripheral tunnel completely surrounding the access tunnels and connecting the access tunnels;

excavating a second portion of the deposit from within the boundaries of such a retort site to form at least one void and leaving a third portion of said deposit, which is to be fragmented by expansion towards said void, within said boundaries; and explosively expanding said third portion of deposit toward said void.

25. A method of forming, in a subterranean deposit containing oil shale, a plurality of in situ oil shale retorts having top end boundaries, bottom end boundaries and side boundaries of the deposit and containing fragmented deposit containing oil shale therein, said retorts being arranged in rows and columns comprising the steps of:

excavating first portions of the subterranean deposit to form an access and peripheral tunnel system for access to individual retort sites comprising a plurality of access tunnels at a level intermediate between the top end boundaries and bottom end boundaries of said retorts being formed, and connecting drifts leading from the access tunnel to the individual retort sites and a peripheral tunnel completely surrounding the access tunnels and connecting the access tunnels;

excavating a second portion of the deposit from within the boundaries of such a retort site to form at least one void and leaving a third portion of said deposit, which is to be fragmented by expansion towards said void, within said boundaries; and explosively expanding said third portion of deposit toward said void.

26. A method of utilizing retort off gas produced in an in situ oil shale retort in an oil shale deposit, comprising the steps of:

withdrawing off gas from the in situ oil shale retort;

generating electrical power in a tunnel extending through the oil shale deposit utilizing at least a portion of the withdrawn off gas; and pumping gas in the tunnel utilizing at least a portion of the generated electrical power.

27. A method as recited in claim 26 wherein the gas comprises air transported from ground level into the tunnel.

28. A method of recovering carbonaceous values from a subterranean oil shale deposit comprising the steps of:

fragmenting oil shale in the oil shale deposit to form an in situ oil shale retort containing a fragmented permeable mass of oil shale particles;

forming a tunnel extending through the oil shale deposit adjacent to and on a level above the retort;

forming a passage between the tunnel and the top of the retort;

passing gas through the passage between the tunnel and the top of the retort for retorting oil shale and producing carbonaceous values from the fragmented oil shale;

removing liquid and gaseous carbonaceous products from the retort;

generating electrical power in a tunnel extending through the oil shale deposit utilizing at least a portion of the the carbonaceous products recovered from the in situ oil shale retore; and pumping gas in the tunnel utilizing at least a portion of the generated electrical power.

29. A method as recited in claim 28 comprising forming a plurality of sloping passages between the tunnel and the top of the retort and passing gas through each of the passages for retorting oil shale.

30. A method of utilizing carbonaceous product recovered from an in situ oil shale retort in a subterranean oil shale deposit containing a fragmented permeable mass of particles containing oil shale, comprising the steps of:

introducing a gas into the top of the retort for retorting carbonaceous products from oil shale in the fragmented mass;

removing the carbonaceous products from the retort; and generating electrical power in a tunnel extending through the oil shale deposit utilizing a portion of the carbonaceous products removed from the retort.

31. A method as recited in claim 30 further comprising pumping at least a portion of the gas utilizing at least a portion of the generated electrical power.

32. A method for retorting oil shale in an in situ oil shale retort containing a fragmented permeable mass of particles containing oil shale in a subterranean oil shale deposit, comprising the steps of:

forming a tunnel at a level above the top of the retort leaving unfragmented deposit between the tunnel and the top of the fragmented mass in the retort;

forming a plurality of gas inlet passages from the tunnel to the top of the retort;

extending an igniter through such a passage to the top of the retort;

utilizing the igniter for establishing a combustion zone at the top of the retort in which carbonaceous material in oil shale is burned;

withdrawing the igniter through the passage when carbonaceous material in oil shale in the fragmented mass is at an ignition temperature;

testing flow resistance of the fragmented mass for uniformity;

introducing oxygen-supplying gas through such a plurality of gas inlet passages for sustaining the combustion zone and advancing the combustion zone through the fragmented mass; and adjusting the effective size of such a gas inlet passage in response to such testing for equalizing flow along various paths in the fragmented mass.

33. A method for retorting oil shale in an in situ oil shale retort containing a fragmented permeable mass of particles containing oil shale in a subterranean oil shale deposit, comprising the steps of:

forming a tunnel at a level above the top of the retort leaving unfragmented formation between the tunnal and the top of the fragmented mass in the retort;

forming a plurality of gas inlet passages from the tunnel to distributed locations at the top of the retort;

introducing oxygen-supplying gas through such a plurality of gas inlet passages for sustaining the combustion zone and advancing the combustion zone through the fragmented mass; and selectively adjusting the rate of introduction of oxygen-supplying gas through such gas inlet passages to such distributed locations for equalizing flow along various paths in the fragmented mass in the retort.

* * * * *

UNITED STATES PATENT AND TRADEMARK OFFICE

CERTIFICATE OF CORRECTION

PATENT NO. : 4,147,388

DATED : April 3, 1979

INVENTOR(S) : Gordon B. French

It is certified that error appears in the above-identified patent and that said Letters Patent are hereby corrected as shown below:

Column 1, line 35, -- in -- should be inserted after "an" and before "situ";

Column 1, line 68, the comma should be deleted after "shale" and before "deposit".

Column 5, line 36, "pf" should be -- of --.

Column 10, line 8, "powdered" should be -- powered --.

Column 15, line 28,"retore" should be -- retort --.

Signed and Sealed this

*Thirty-first* Day of *July 1979*

[SEAL]

*Attest:*

*Attesting Officer*

LUTRELLE F. PARKER

*Acting Commissioner of Patents and Trademarks*